US007305914B2

(12) United States Patent
Gray, Jr.

(10) Patent No.: US 7,305,914 B2
(45) Date of Patent: Dec. 11, 2007

(54) HYDRAULIC ACTUATOR CONTROL VALVE

(75) Inventor: Charles L. Gray, Jr., Pinckney, MI (US)

(73) Assignee: The United States of America, as represented by the Administrator of the Environmental Protection Agency, Washington, DC (US)

( * ) Notice: Subject to any disclaimer, the term of this patent is extended or adjusted under 35 U.S.C. 154(b) by 800 days.

(21) Appl. No.: 10/767,547

(22) Filed: Jan. 28, 2004

(65) Prior Publication Data

US 2005/0163639 A1 Jul. 28, 2005

(51) Int. Cl.
*F15B 13/044* (2006.01)
*F15B 9/08* (2006.01)

(52) U.S. Cl. ..... 91/462; 91/463; 91/464

(58) Field of Classification Search ..... 60/472; 91/47, 51, 415, 462, 463, 464, 466, 467
See application file for complete search history.

(56) References Cited

U.S. PATENT DOCUMENTS

| | | | | |
|---|---|---|---|---|
| 2,530,242 A | | 11/1950 | Harrington | 103/38 |
| 2,860,606 A | | 11/1958 | Ainsworth | 121/46.5 |
| 3,290,996 A | * | 12/1966 | Floyd | 91/461 |
| 3,394,545 A | | 7/1968 | Thompson et al. | 60/52 |
| 3,628,421 A | | 12/1971 | George | 91/358 |
| 3,831,490 A | | 8/1974 | Olson et al. | 91/387 |
| 3,872,773 A | | 3/1975 | Denker | 91/388 |
| 4,207,803 A | | 6/1980 | Göttling | 91/410 |
| 4,311,083 A | | 1/1982 | Guillon | 91/19 |
| 4,348,943 A | | 9/1982 | Bouyoucos | 91/355 |
| 4,519,294 A | | 5/1985 | Hemens | 91/374 |
| 4,759,258 A | | 7/1988 | Maltby et al. | 91/171 |

(Continued)

FOREIGN PATENT DOCUMENTS

DE 38 24 205 A1 1/1990

(Continued)

OTHER PUBLICATIONS

Gray, Jr., Charles L., U.S. Appl. No. 10/379,992, filed Mar. 6, 2003, entitled "High-Efficiency, Large Angle, Variable Displacement Hydraulic Pump/Motor."

(Continued)

*Primary Examiner*—Thomas E. Lazo
(74) *Attorney, Agent, or Firm*—Seed IP Law Group, PLLC

(57) ABSTRACT

An actuator includes a piston within a cylinder, the cylinder having a first fluid port in communication with an open side of the piston, and a second fluid port in communication with a shaft side of the piston. The piston travels in a first direction, toward the shaft side of the piston and in a second direction, toward the open side of the piston. The actuator includes a valve circuit configured to selectively couple the first fluid port with a high-pressure fluid source when piston travel in the first direction is desired, and with a low-pressure fluid source when piston travel in the second direction is desired. The valve circuit is further configured to couple the second fluid port to the high-pressure fluid source when piston travel is desired in the first or second direction, and to close the first and second fluid ports when no piston travel is desired.

24 Claims, 7 Drawing Sheets

U.S. PATENT DOCUMENTS

| | | | | |
|---|---|---|---|---|
| 4,807,517 | A | 2/1989 | Daeschner | 91/384 |
| 4,825,745 | A | 5/1989 | Kuttruf | 91/24 |
| 4,893,549 | A | 1/1990 | Forster | 92/12.2 |
| 4,958,495 | A | 9/1990 | Yamaguchi | 60/468 |
| 4,958,548 | A | 9/1990 | Schulze | 91/420 |
| 5,094,144 | A * | 3/1992 | Akasaka et al. | 91/486 |
| 5,205,201 | A | 4/1993 | Göllner | 91/387 |
| 5,271,313 | A | 12/1993 | Lindegren, III | 91/358 R |
| 5,421,294 | A | 6/1995 | Ruoff et al. | 123/90.17 |
| 5,495,912 | A | 3/1996 | Gray, Jr. et al. | 180/165 |
| 6,109,284 | A | 8/2000 | Johnson et al. | 137/1 |
| 6,481,689 | B2 | 11/2002 | Grill | 251/129.07 |
| 2003/0015155 | A1 | 1/2003 | Turner et al. | 123/90.12 |
| 2003/0019948 | A1 | 1/2003 | Shinogle et al. | 239/90 |
| 2003/0110935 | A1 | 6/2003 | Nippert | 91/476 |
| 2004/0011031 | A1 | 1/2004 | Gray, Jr. | 60/325 |
| 2004/0173089 | A1 | 9/2004 | Gray, Jr. et al. | 91/505 |
| 2005/0120873 | A1 | 6/2005 | Gray, Jr. | 91/418 |

FOREIGN PATENT DOCUMENTS

| | | | |
|---|---|---|---|
| DE | 38247205 | A * | 1/1990 |
| DE | 198 18 126 | A1 | 10/1999 |
| EP | 1 091 131 | A1 | 4/2001 |
| FR | 2.106.951 | | 5/1972 |
| FR | 2106951 | A * | 5/1972 |

OTHER PUBLICATIONS

Gray, Jr., Charles L., U.S. Appl. No. 10/620,726, filed Jul. 15, 2003, entitled "Opposing Pump/Motors."

Gray, Jr., Charles L., U.S. Appl. No. 10/731,985, filed Dec. 10, 2003, entitled "Method and Device for Switching Hydraulic Fluid Supplies, Such as for a Hydraulic Pump/Motor."

* cited by examiner

HYDRAULIC ACTUATOR CONTROL VALVE

BACKGROUND OF THE INVENTION

1. Field of the Invention

This application relates generally to hydraulic valves, and in particular to valves for controlling hydraulic actuators, for example, actuators associated with pump/motors.

2. Description of the Related Art

FIG. 1 shows a hydraulic actuator 100, including a piston 104, a cylinder 102, and a shaft 110. The piston 104 has a surface 104*a* that, in use, is subject to fluid pressure. Surface 104*a* may be referred to herein as the open side, working side, head side, or large side. The piston 104 also has a surface 104*b*, referred to herein as the shaft side, due to the presence of the shaft 110 coupled thereto. Other terms used in the art include piston rod side, annular chamber side, and small side. It will be understood that the selection of terms is irrelevant to the function of the device, and has no bearing on the scope of the invention or claims.

Such an actuator is operated by providing pressurized fluid at port 114 to a shaft side chamber 108, and selectively providing pressurized fluid at port 112 to an open side chamber 106. If fluid force against the open side surface of the piston 104 exceeds a force against the shaft side surface of the piston, the piston will rise, as viewed in FIGS. 1-3. Conversely, if the force exerted by pressurized fluid against the shaft side surface 104*b* of the piston 104 exceeds the force of fluid against the open side surface 104*a*, the piston 104 will drop. The position 104 of the actuator 100 is controlled by controlling the fluid pressure in the open side chamber 106 of the cylinder 102 of the actuator 100. However, it will be noted that the surface area of the shaft side surface 104*b* of the piston 104 is less than that of the open side surface 104*a* of the piston 104, owing to the volume of the shaft 110, which reduces the surface area of surface 104*b*. Accordingly, an equal fluid pressure in each of the shaft side and open side chambers 108, 106 of the cylinder 102 will result in a greater force being exerted on the open side surface 104*a* of the piston 104 than on the shaft side surface 104*b*. Thus, if the fluid pressure in the shaft side and open side chambers 108, 106 of the cylinder 102 is equal, the piston 104 will rise.

Control of such an actuator may be achieved through the use of an actuator control valve such as that shown at reference numeral 116. The actuator control valve 116 is controlled by a solenoid 132, which is in turn controlled by an electronic control unit voltage command signal 154. The force exerted by the shaft 134 of the solenoid 132 on the spool 118 of the valve 116 is determined by the voltage level provide by the command signal 154. The force exerted by the shaft 134 on the spool, in opposition to a biasing force of the spring 138, controls the position of the spool 118 within the valve housing 117. The valve 116 includes three ports, 126, 122, 124. The first port 126 is coupled to a high-pressure fluid source 150. The third port 124 is coupled to a low-pressure fluid source 152, while the second port 122 is coupled to the open side port 112 of the actuator cylinder 102 via control line 128.

It should be noted that the shaft side port 114 of the actuator is coupled directly to the high-pressure fluid source 150 via high-pressure supply line 130. The spool 118 includes an annular channel 120, which is configured to link either the high-pressure fluid source 150 or the low-pressure fluid source 152 to the second valve port 122 and to the open side port 112 of the actuator 100. The spring 138 biases the spool 118 in an upward direction. Thus, when the solenoid

132 is activated to press downward on the spool 118, the spring 138 is compressed as the spool 118 drops.

Actuators of the type described above are sometimes referred to as differential actuators, because they respond to a difference in force against the respective surfaces of the piston. The relative forward and reverse response of such an actuator can be selected by selecting the area of the shaft and the pressure applied to the open side chamber 106. For example, assuming the cylinder 102 has a transverse sectional area of two square inches, and the shaft 110 has a transverse sectional area of one square inch, the effective surface area of the shaft side surface 104*b* of the piston 104 will be one square inch, while the effective surface area of the open side surface 104*a* of the piston 104 will be two square inches. Further, assuming a high-pressure source 150 of 1,000 psi, and a low-pressure source 152 of 20 psi, coupling the high-pressure source 150 to the open side chamber 106 means that the force acting on the open side surface 104*a* of the piston 104 is:

$$\frac{1{,}000\ \text{pounds}}{\text{in}^2} \times 2\ \text{in}^2 = 2{,}000\ \text{pounds},$$

While the same high pressure in the shaft side chamber 108 results in a force acting on the shaft side surface 104*b* of the piston 104 of:

$$\frac{1{,}000\ \text{pounds}}{\text{in}^2} \times 1\ \text{in}^2 = 1{,}000\ \text{pounds}.$$

The differential force, then, is 2,000 pounds−1,000 pounds=1,000 pounds, pushing the actuator 100 toward the shaft side. On the other hand, if the low pressure 152 is applied to the open side chamber 106, the force acting on the open side surface 104*a* of the piston 104 is:

$$\frac{20\ \text{pounds}}{\text{in}^2} \times 2\ \text{in}^2 = 40\ \text{pounds},$$

while the force acting on the shaft side surface of the piston remains at 1,000 pounds. Accordingly, the differential force is 1,000 pounds−40 pounds=960 pounds, pushing the actuator 100 toward the open side of the piston 104.

It will be recognized that, by selecting the diameter of the shaft, relative to the diameter of the cylinder, the forces acting on the actuator in a forward direction and a reverse direction may be made to be approximately equal, as described above, or may be made to operate with much higher forces in one direction than the other. It will also be recognized that the relative pressures of the high and low pressure fluid supplies, and the dimensions of the actuator, may be selectively modified according to the particular application, with the values used above being selected for purposes of illustration only.

FIG. 1 shows the actuator valve 116 with the spool 118 in a first, upper position. In this position, the annular channel 120 is positioned to couple the high fluid pressure at the first port 126 with the open side chamber 106 of the actuator 100, via the second actuator control valve port 122 and the pressure line 128. Accordingly, fluid from the high-pressure fluid source 150 is driven into the open side chamber 106 of the actuator 100. As previously explained, even though the shaft side chamber 108 of the actuator 100 is coupled directly to the high-pressure fluid source 150, an equal pressure in the open side chamber 106 of the actuator 100 is sufficient to drive the piston 104 of the actuator 100 upward. Accordingly, when the spool 118 is in the first position, as shown in FIG. 1, the piston 104 of the actuator 100 is driven upward.

FIG. 3 shows the actuator control valve 116 with the spool 118 in a third, lower position. In this position, the annular channel 120 couples the low-pressure fluid source 152, to the open side chamber 106 of the actuator 100, via the second valve port 122 and the pressure line 128. In this position, the high pressure in the shaft side chamber 108 of the actuator 100 is sufficient to drive the piston downward against the low pressure, in the open side chamber 106 of the actuator 100.

It will be noted that there is a linking arm 136, which serves to couple the actuator shaft 110 to the spring 138. The linking arm 136 provides positional feedback to the actuator valve. As the actuator shaft 110 drops, the linking arm 136 compresses the spring 138. When the increasing upward force exerted by the compressed spring 138 exceeds the downward force exerted by the solenoid 132, the spool valve 118 will be pressed upward into the second position, as shown in FIG. 2. This may occur at any point in the travel of the piston 104, in as much as the force exerted by the solenoid 132 is variable, based upon the voltage supplied by the command signal 154.

FIG. 2 shows the spool 118 in a second, central position. As may be seen, the annular channel 120 is not in fluid communication with either the first port 126 or the third port 124. Thus, the second port 122 is coupled to neither the high-pressure fluid source 150 nor the low-pressure fluid source 152. In this position, the actuator control valve 116 arrests the piston 104 at any desired position. Because the fluid in the pressure line 128 and the lower chamber 106 is incompressible, the high-pressure fluid of the upper chamber 108 cannot drive the piston 104 downward.

Finally, when the spool 118 is in the first position, causing the actuator shaft 110 to rise, as previously described, it may be seen that the linking arm 136 progressively reduces the upward bias on the feedback spring 138 as the shaft 110 rises. If, during the upward travel of the actuator, the upward biasing force applied by the spring 138 on the spool 118 drops below the downward biasing force applied by the shaft 134 of the solenoid 132, the spool 118 will drop into the second position, decoupling the open side chamber 106 from the high pressure fluid source 150, and arresting the piston at that position.

Various valve configurations and systems for controlling actuators are described in the following patents, which are incorporated herein by reference in their entireties: U.S. Pat. No. 4,311,083, issued to Guillon; U.S. Pat. No. 4,958,495, issued to Yamaguchi; and U.S. Pat. No. 5,421,294, issued to Ruoff, et al.

BRIEF SUMMARY OF THE INVENTION

According to an embodiment of the invention, a hydraulic actuator device is provided, including a piston within a cylinder, the cylinder having a first fluid port in fluid communication with an open side of the piston, and a second fluid port in fluid communication with a shaft side of the piston. The piston is configured to travel in a first direction, toward the shaft side of the piston and in a second direction, toward the open side of the piston. The actuator device also includes a valve circuit configured to selectively couple the first fluid port with a high-pressure fluid source when piston travel in the first direction is desired, and with a low-pressure fluid source when piston travel in the second direction is desired. The valve circuit is further configured to couple the second fluid port to the high-pressure fluid source when piston travel is desired in the first or second direction, and to close the second fluid port when no piston travel is desired. The valve circuit may also be configured to close the first fluid port when no piston travel is desired.

According to an embodiment of the invention the valve circuit includes a spool valve having first and second control ports coupled to the first and second fluid ports, respectively. The spool valve is configured to place the first and second control ports in fluid communication with the high-pressure fluid source when a spool of the spool valve is in a first position, to close the second control port when the spool is in a second position, and to place the first control port in fluid communication with the low-pressure fluid source and the second control port in fluid communication with the high-pressure fluid source when the spool is in a third position.

According to another embodiment of the invention, a system is provided, including a pump/motor configured to have a displacement directly related to a stroke angle of a cylinder barrel relative to a drive plate. The system also includes an actuator coupled to the cylinder barrel, configured to vary the stroke angle of the cylinder barrel according to a position of a shaft of the actuator. A piston coupled to the shaft is configured to move within a cylinder in response to differential, pressure acting on first and second surfaces thereof. A valve is provided, configured to couple a high-pressure fluid source to the actuator such that high-pressure fluid is made to act on the first and second surfaces of the piston when movement of the shaft in a first direction is desired. The valve is configured to couple the high-pressure fluid source and a low pressure fluid source to the actuator such that high-pressure fluid is made to act on the first surface of the piston, while low-pressure fluid is made to act on the second surface of the piston, when movement of the shaft in a second direction is desired. Finally, the valve is configured to decouple the high and low-pressure fluid sources from the actuator when no movement of the shaft is desired.

A method of operation is provided, according to an additional embodiment of the invention, including the steps of applying high pressure to first and second surfaces of a piston coupled to a shaft of an actuator to move the shaft in a first direction, applying high pressure to the first surface and low pressure to the second surface of the piston to move the shaft in a second direction, and shutting off pressure access to the first and second surfaces of the piston, to arrest the actuator.

BRIEF DESCRIPTION OF THE SEVERAL VIEWS OF THE DRAWING(S)

DETAILED DESCRIPTION OF THE INVENTION

In some applications, it is desirable and/or necessary for an actuator to operate at high speeds. However, current actuators, such as those described above with respect to FIGS. 1-3, have limitations at higher speeds. While these limitations may be due to several factors, applicant believes that position control is a primary problem.

More particularly, and described again with reference to FIGS. 1-3 for purposes of illustration, because the high pressure in a hydraulic system such as that described can always receive or supply high pressure fluid, for example when the high pressure is achieved by forcing fluid against a gas volume within an accumulator, there is a compressibility associated with the high- and low-pressure fluid sources 150, 152. Additionally, the high pressure system will always have some compressibility, even without an accumulator. Fluid transmission lines are never perfect, and thus impart some springiness to the circuit. The fluid may have some gas in suspension, which also contributes to the compressibility of the fluid source. These and other factors all contribute to a greater or lesser amount of give in the high pressure circuit. The compressibility is directly related to the volume of fluid in the high pressure system.

Figure 2:
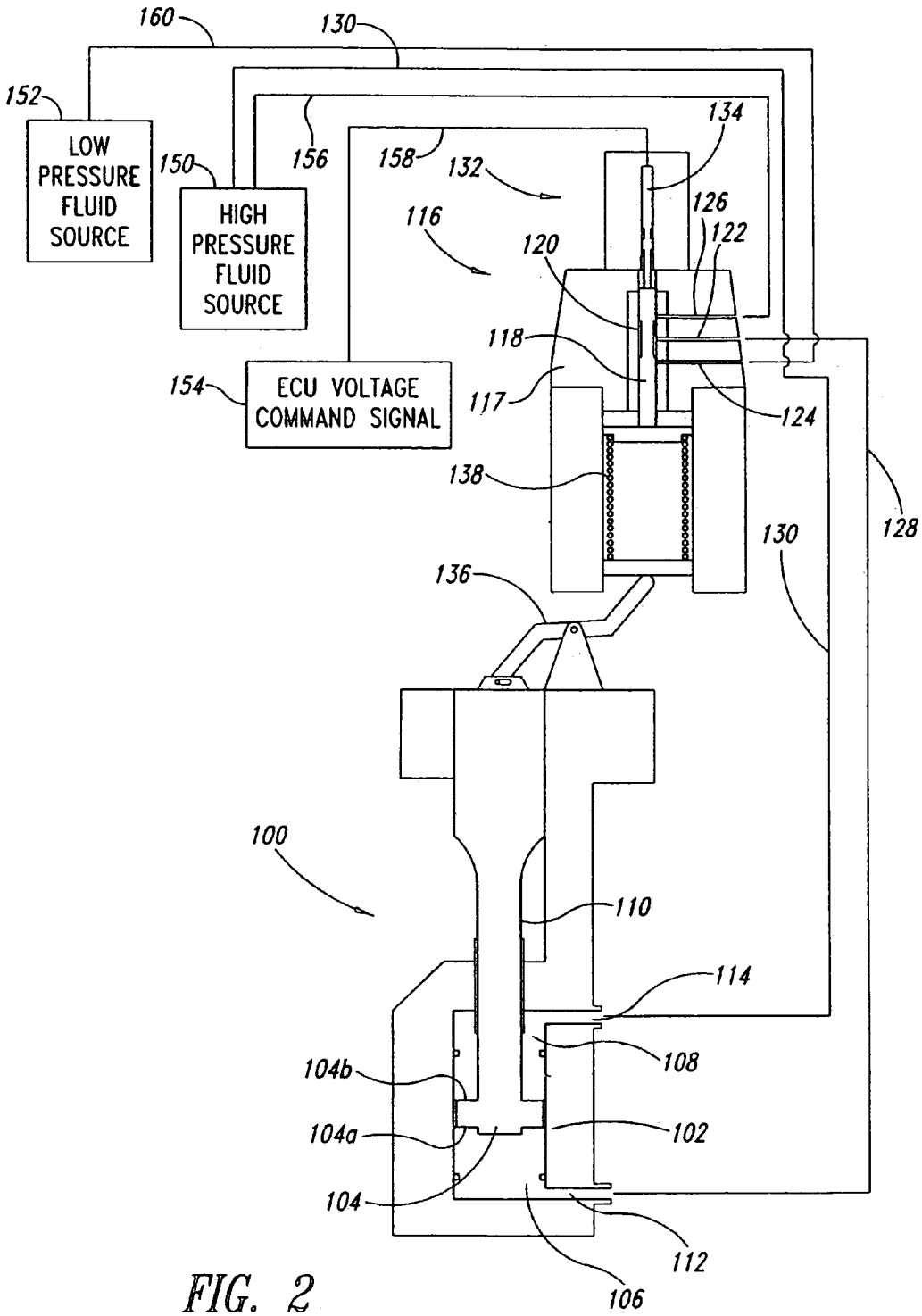
FIG. 2 (Prior Art)
FIG. 2 shows the hydraulic actuator and control valve of FIG. 1 in a second configuration.
Figure 3:
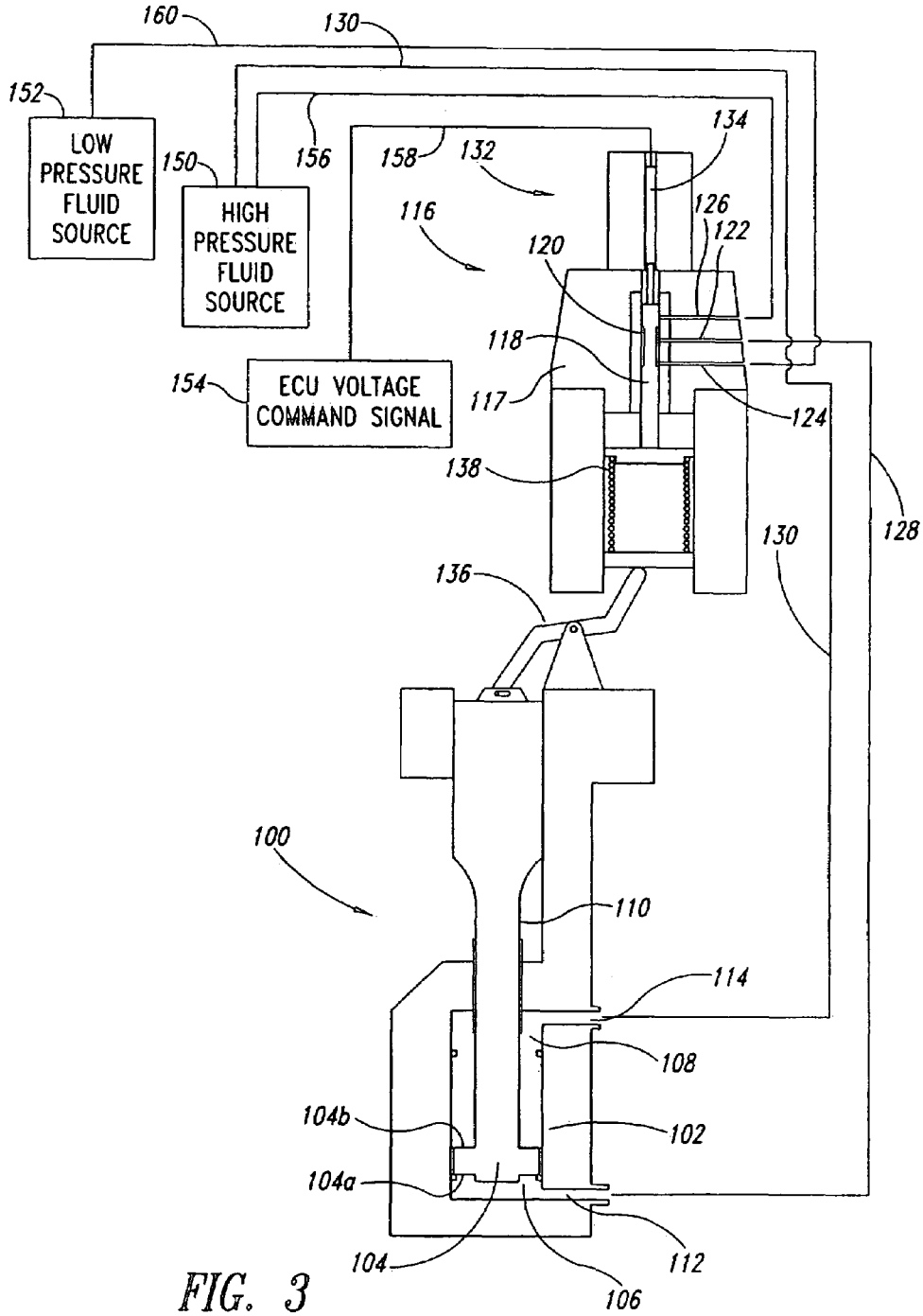
FIG. 3 (Prior Art)
FIG. 3 shows the hydraulic actuator and control valve of FIG. 1 in a third configuration.

In those situations where the piston 104 is forced upward at a very high rate of speed, and then the spool 118 is moved to the position indicated in FIG. 2 while the piston 104 is at a point between the upper and lower limits, there is a tendency for the piston 104 and shaft 110 to overshoot the stopping point, or to bounce, due to the compressibility or give within the high-pressure circuit, in combination with the kinetic energy of the actuator, the inertia of the mass (not shown) being moved by the actuator, and the mass of the fluid in the lines. Such an overshoot of the actuator 100 may be detrimental in some applications, where it is desirable or required that the actuator move very swiftly to a selected position and then stop substantially immediately at that position.

In describing various embodiments of the invention, with reference to the figures, like reference numerals will be used when referring to features that are substantially identical to those in previous figures.

Figure 4:
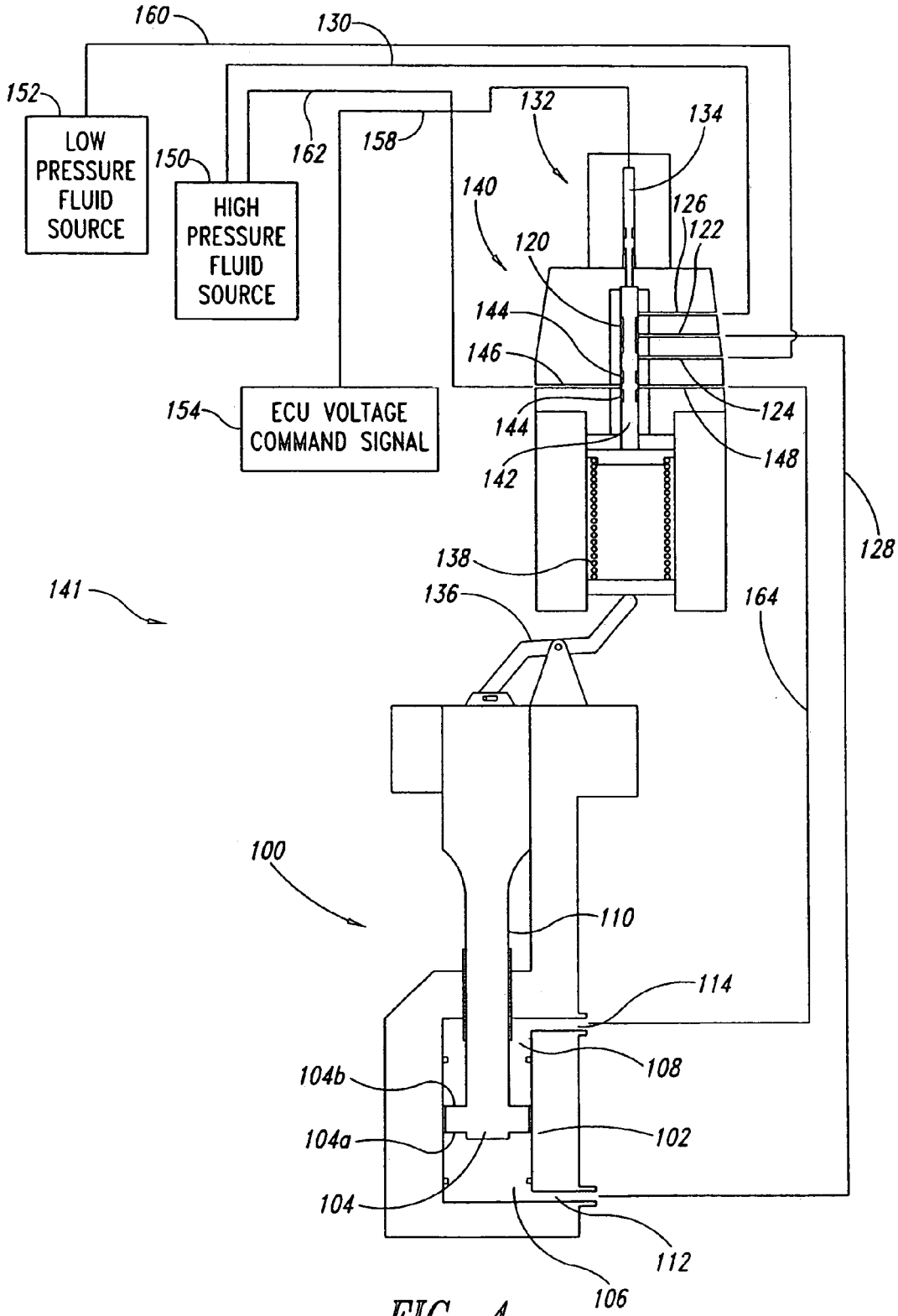
FIG. 4 shows a hydraulic actuator and control valve according to an embodiment of the invention.

FIG. 4 shows an actuator system 141 according to an embodiment of the invention. The shaft side control line 164 is coupled to a fourth port 148 in the actuator control valve 140. The line passes through the actuator control valve 140 to a fifth port 146, where it is coupled to the high-pressure fluid source 150 via high-pressure line 162. The spool 142 includes two annular channels 144, as well as the annular channel 120 illustrated in previous figures.

The spool 142 of FIG. 4 is shown in a middle, or second position. It may be seen that when the spool 142 is in an upper (first) or lower (third) position, corresponding to the first and third positions of spool 118, one or the other of the annular channels 144 is aligned with the fourth and fifth ports 148 and 146 of the actuator control valve 140, permitting free passage of high-pressure fluid past the valve 140 and into or out of the upper chamber 108 of the actuator 100. However, when the spool 142 is in the second position, as illustrated in FIG. 4, the fluid passage between the fourth and fifth ports 148 and 146 is cut off, preventing fluid flow between the, shaft side chamber 108 of the actuator 100 and the high-pressure fluid source 150. Cutting off the fluid passage between the high-pressure fluid source 150 and the shaft side chamber 108 effectively removes the high-pressure source from the high-pressure circuit, as seen by the actuator.

Additionally, because an actuator control valve of the type described herein may be placed close to the actuator, and may lie some distance from the high-pressure source 150, by isolating the actuator 100 from the high-pressure fluid source 150 at the actuator valve 140, most of the length of the transmission lines between the high-pressure fluid source 150 and the actuator is isolated from the actuator 100. The remaining high-pressure fluid in the shaft side chamber 108 of the actuator and the shaft side control line 164 is a very small volume of fluid, in comparison to the total fluid in the high-pressure circuit, and thus is much closer to the ideal of a non-compressible fluid. This effectively prevents the piston 104 from overshooting its position, allowing, the piston to be arrested substantially instantaneously.

The actuator control valve 140, according to another embodiment of the invention, may also include a second solenoid (not shown) positioned on the bottom of the spool valve replacing the compression spring 138 and the mechanical linkage 136. Such a configuration includes a position sensor coupled to the shaft of the actuator 100 to complete the feedback circuit. In such a system, a voltage signal is provided to the second solenoid, which is inversely related to the position of the actuator shaft, as determined by the position sensor. For example, as the actuator shaft drops downward, the value of the voltage signal increases, and vice-versa.

Figure 5:
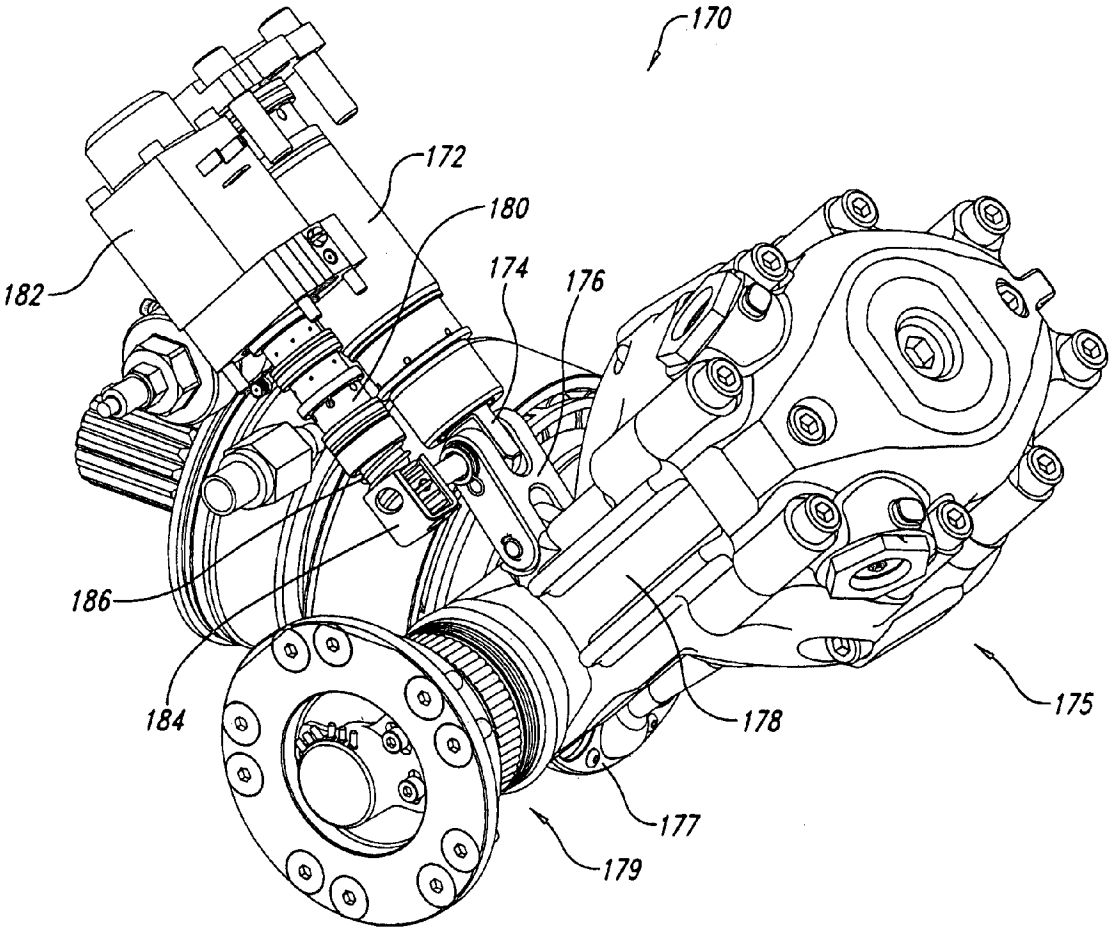
FIG. 5 shows a hydraulic machine including an actuator and control valve according to another embodiment of the invention.

Referring now to FIGS. 5-9, a hydraulic system according to another embodiment of the invention is described. FIG. 5 illustrates portions of a hydraulic bent-axis pump/motor 170. The pump/motor 170 includes a yoke 178 configured to rotate on a trunnion assembly 179 for the purpose of varying a stroke angle between a drive plate 177 and a piston-and-cylinder assembly 175 of the pump/motor 170. Detailed operation of bent-axis pump/motors is described in U.S. Pat. No. 4,893,549, issued to Forester, and U.S. patent application Ser. Nos. 10/379,992 and 10/620,726, which are incorporated herein by reference, in their entirety. While the description of the principles of the invention provided herein is in reference to a bent-axis pump/motor, it will be recognized that a variety of types of variable-displacement pump/motors, including swash-plate and sliding valve plate types, may benefit from and use the present invention. Accordingly, the scope of the invention includes all such pump/motors, as well as other hydraulic devices employing differential actuators of the type described herein.

The stroke angle of the pump/motor 170 is established and controlled by actuator 172, having a shaft 174 coupled to the yoke 178 by a linkage 176. The actuator 172 is controlled by actuator control valve 180 and solenoid 182. When the shaft 174 of the actuator 172 is fully extended, the yoke 178 is placed at a stroke angle of 0°, at which point the displacement of the pump/motor 170 is substantially zero. In this position, the pump/motor is in a neutral configuration.

On the other hand, when the shaft 174 of the actuator 172 is fully retracted, as shown in FIG. 5, the yoke 178 is at a maximum stroke angle, corresponding to a maximum transfer of energy through the pump/motor 170.

A feedback linkage 184 provides feedback pressure to the valve 180 via feedback spring 186. As the position of the actuator shaft 174 and linkage 176 changes, a corresponding biasing pressure exerted by the feedback linkage 184 on the feedback spring 186 also changes.

Figure 6:
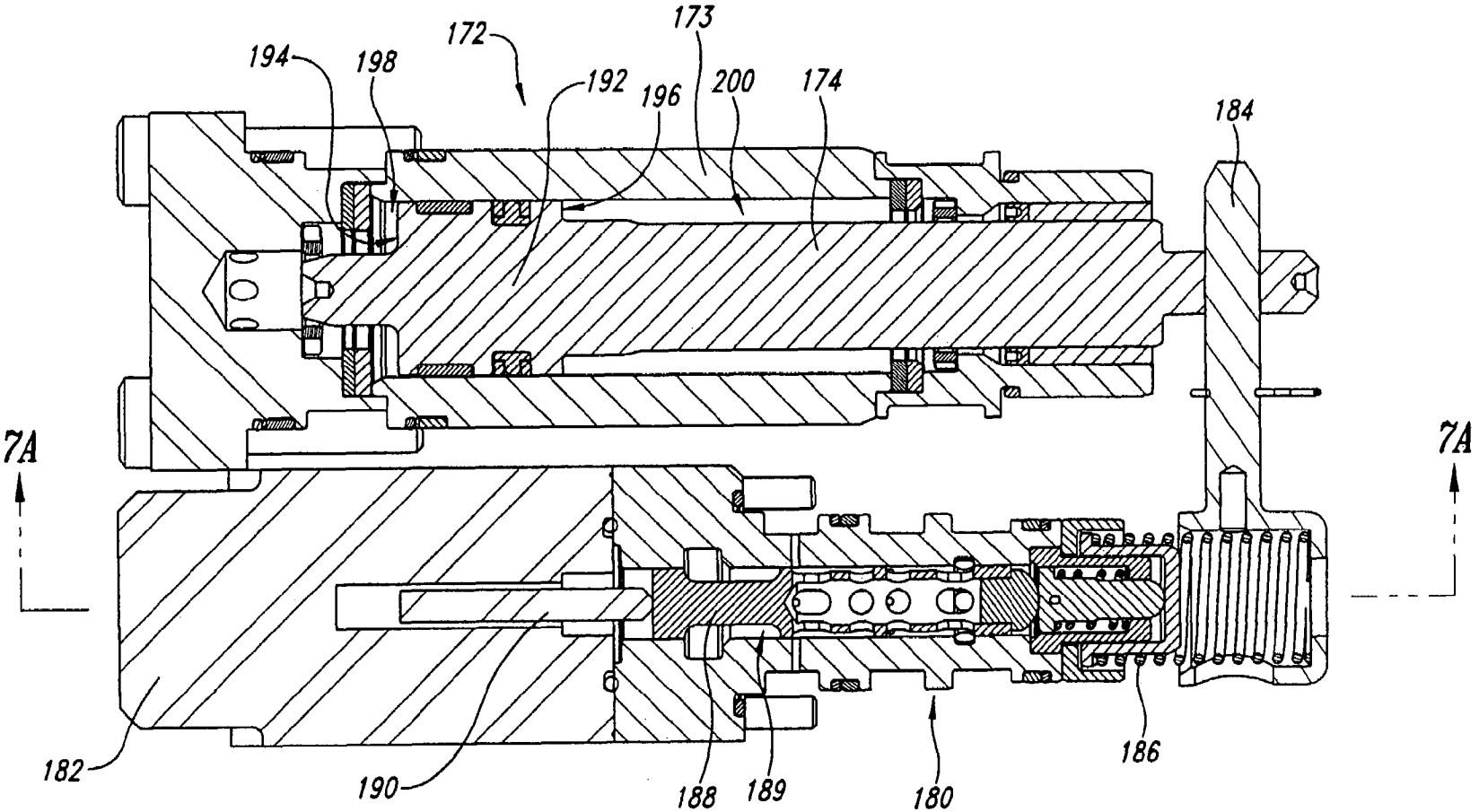
FIG. 6 shows a sectional view of the hydraulic actuator and control valve of FIG. 5.

FIG. 6 is a cross-sectional view of the actuator 172 and actuator valve 180, taken along a plane that lies on the axes of the actuator 172 and the actuator valve 180. The actuator 172 includes the shaft 174 and piston 192, having an open side surface 194 and a shaft side surface 196 traveling within a cylinder 173. The cylinder 173 includes an open side chamber 198 and a shaft side chamber 200 on respective sides of the piston 192. The actuator control valve 180 includes a solenoid 182 having a solenoid shaft 190. The actuator valve 180 also includes a spool 188 configured to move within a bore 189 of the actuator valve 180.

Figure 7A:
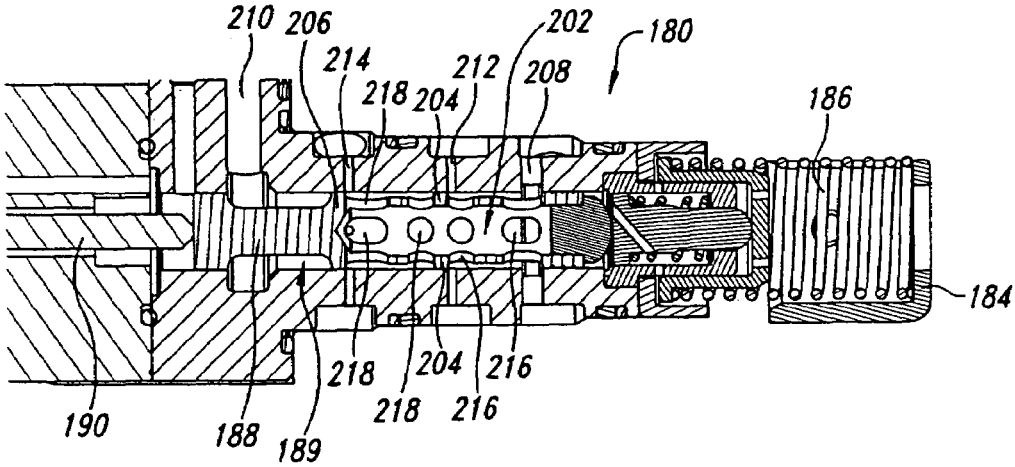
FIG. 7A shows a sectional view of the control valve of FIG. 5, transverse to the section of FIG. 6, taken along line 7A-7A of FIG. 6.
Figure 7B:
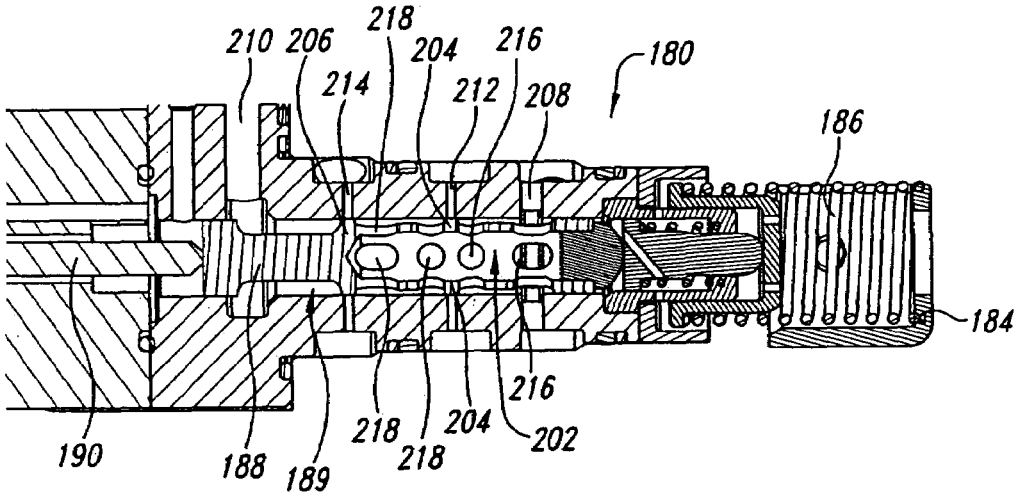
FIG. 7B shows the control valve of FIG. 7A in a second configuration.
Figure 7C:
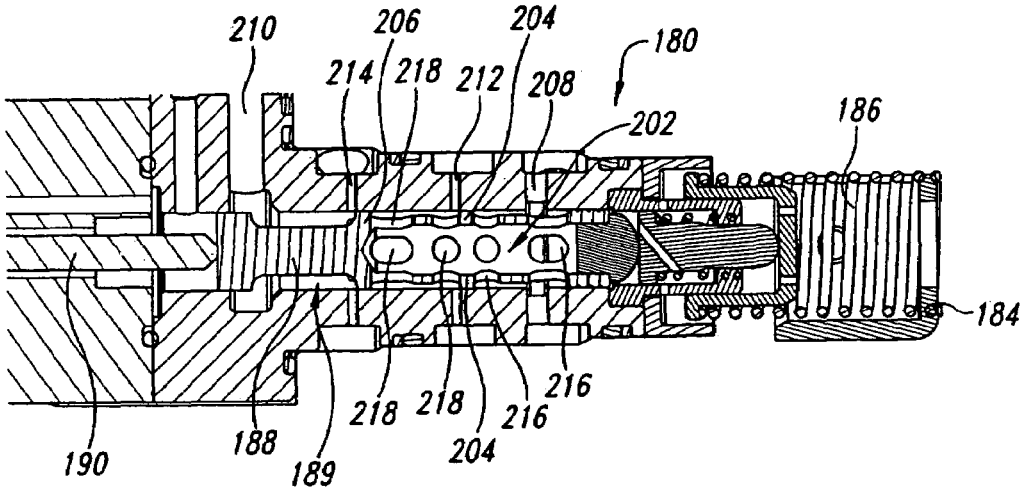
FIG. 7C shows the control valve of FIG. 7A in a third configuration.

FIGS. 7A-7C are cross-sectional views of the actuator control valve 180, taken along line 7A-7A of FIG. 6 It may be seen that the spool 188 includes a hollow region 202 having a plurality of fluid passages 216, 218. A first land 204 is located at an approximate midpoint of the hollow region. A second, land 206 is located at an end of the hollow region. The fluid passages 216 are located to the right of the first land 204, as viewed in FIGS. 7A-7C, while the fluid passages 218 are located to the left of the first land 204. High- and low-pressure fluid ports 208, 210 are in fluid communication with high- and low-pressure sources, respectively (not shown). Shaft side and open side control ports 212, 214 are in fluid communication, via channels not shown, with the shaft side and open side chambers 200, 198, of the actuator 172, respectively.

In describing the principles of operation of the actuator control valve 180, as viewed in FIGS. 7A-7C, reference is also made to the actuator 172 of FIGS. 5 and 6 for the purpose of describing the behavior of the actuator 172 and the assembly 175 in response to changes in the actuator control valve.

Figure 1:
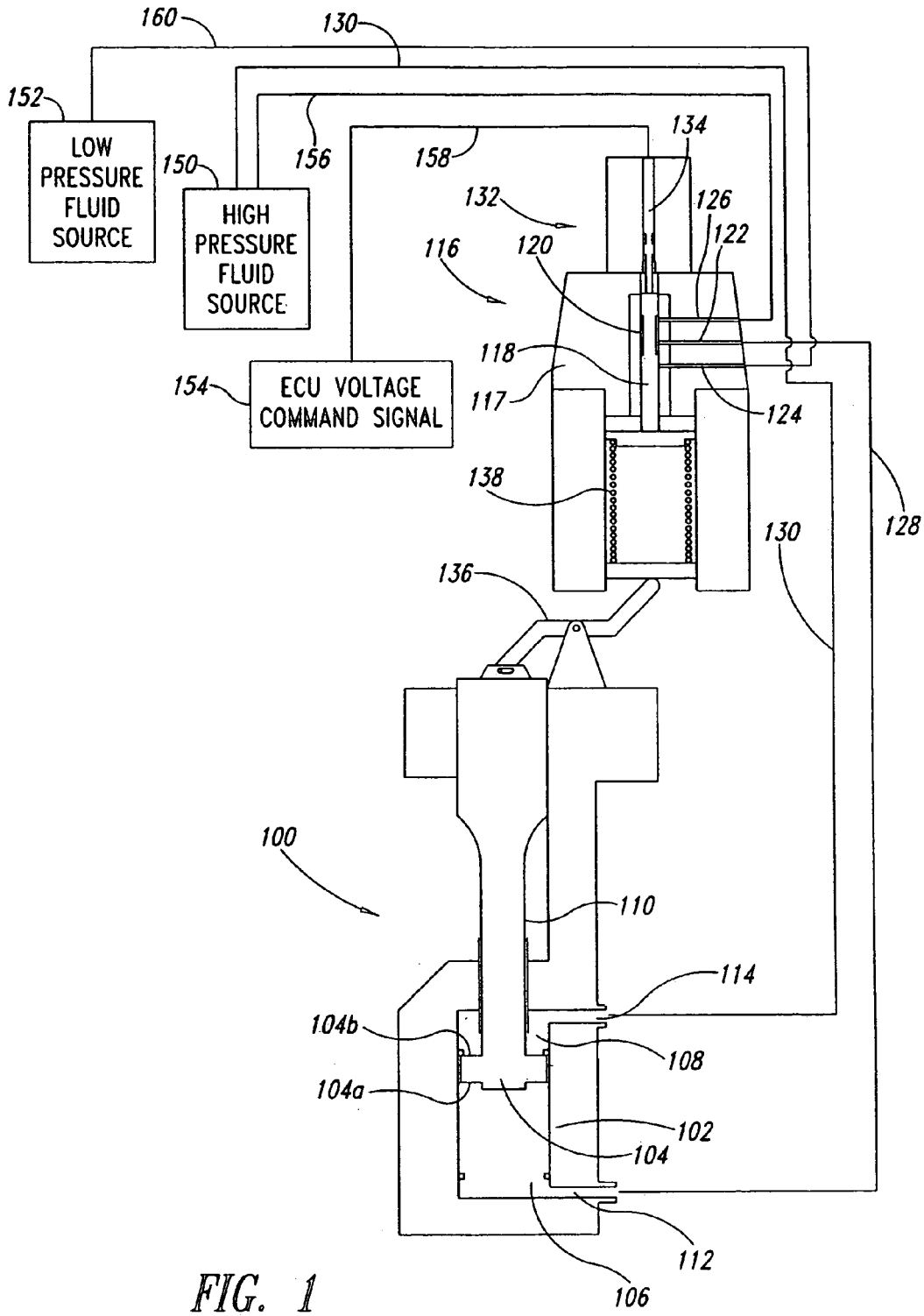
FIG. 1 (Prior Art)
FIG. 1 shows, diagrammatically, a hydraulic actuator and control valve according to known art.

FIG. 7A shows the spool 188 of the actuator valve 180 in a position corresponding to the position of the spool 118 of FIG. 1, to the extent that, in this position, both the shaft side and open side chambers 200, 198, are placed in fluid communication with the high-pressure fluid source. It may be seen, looking at FIG. 7A, that high-pressure fluid from the high-pressure fluid port 208, entering the valve bore 189, passes freely into the hollow region 202 of the spool 188, via the fluid passages 216. The shaft side control port 212, which is in fluid contact with the shaft side chamber 200 of the actuator 172, is also in fluid communication with the valve bore 189 and the hollow region 202 of the spool 188, via the fluid passages 216. With the spool 188 in the position shown in FIG. 7A, high-pressure fluid passing into the hollow region 202 of the spool 188 is free to transit the open side control port 214 to the open side chamber 198, via the fluid passages 218. In this configuration, as described with reference to FIG. 1, the actuator piston 192 and shaft 174 are driven toward the shaft 174 by the superior force acting on the open side surface 194 of the piston 192. Fluid in the shaft side chamber 200 of the actuator is driven therefrom by compression of the chamber as the piston 192 travels within the actuator cylinder 173, to pass back through the shaft side control port 212 to the actuator valve bore 189.

During normal operations, voltage levels provided by a control signal to the solenoid 182 constantly vary, according to changing demands of a particular application. Accordingly, the solenoid shaft 190 exerts a varying degree of pressure on the spool 188, in a rightward direction, as viewed in FIGS. 7A-7C. As previously described with reference to FIG. 6, movement of the actuator shaft 174 is coupled to the actuator valve 180 via the feedback linkage 184 and the feedback spring 186. When the leftward biasing force of the feedback spring 186 is overcome by the rightward force of the solenoid shaft 190, either because the force exerted by the feedback spring 186 has diminished due to movement of the feedback linkage 184, or because pressure exerted by the solenoid shaft 190 has increased due to an increase in control voltage to the solenoid 182, the spool 188 will move rightward to a second position, as illustrated in FIG. 7B.

The position of the spool shown in FIG. 7B corresponds, functionally, with the position of the spool 142, as shown in FIG. 4. In this position, it may be seen that the first and second lands 204, 206 are positioned to close the shaft side and open side control ports 212, 214, respectively. Because both control ports 212, 214 are closed, movement of the piston 192 is arrested substantially without overshoot, as described with reference to FIG. 4. In the configuration depicted in FIG. 7B, both the high- and low-pressure fluid sources are completely isolated from the actuator 172.

If the spool 188 continues to travel to the right as viewed in FIGS. 7A-7C, the spool 188 will move to a third position, as shown in FIG. 7C. It may be seen that the shaft side chamber 200 is again in fluid communication with the high-pressure fluid source. In this case, that communication is via the shaft side control port 212, the fluid passages 218 to the hollow region 202, and thence to the high-pressure fluid port 208 via the fluid passages 216. Meanwhile, the open side chamber 198 of the actuator 172 is now in fluid communication with the low-pressure fluid source via the open side control port 214, the actuator valve bore 189, and the low-pressure fluid supply port 210. In this configuration, high-pressure fluid passes, via the actuator valve 180, to the shaft side chamber of the actuator 172, driving the piston 192 to the left, as viewed in FIG. 6. Fluid in the open side chamber 198 of the actuator 172 is driven by the movement of the piston 192 through the valve 180 to the low-pressure fluid source, via the low-pressure fluid port 210. It may be seen, referring to FIG. 6, that as the piston 192 and shaft 174 move leftward, tension is added to the feedback spring 186 by the feedback linkage 184, providing a steadily increasing leftward bias to the spool 188. If the leftward bias of the spring 186 increases to a point that exceeds the rightward bias of the solenoid shaft 190 before the piston 192 reaches a leftward extreme of its travel, the spool 188 will move to the left to the second position, as shown in FIG. 7B, thereby arresting the piston 192, as described with reference to FIG. 7B.

In the event of a loss of power to the solenoid 182 tasked to control the actuator 172, rightward biasing force provided by the solenoid shaft 190 is lost. In such a case, the feedback spring 186 is unopposed, and drives the spool 188 of the valve 180 to the first position, as shown in FIG. 7A. In this position, as previously described, the high-pressure sources are placed in fluid communication with both the shaft side and the open side chambers 200, 198 of the actuator 173, driving the actuator rightward, to a fully extended position, as described with reference to FIG. 7A. As previously explained, when the shaft 174 is fully extended, the yoke 178 is placed at a zero stroke angle, placing the pump/motor 170 in a neutral configuration. This arrangement affords the pump/motor 170 a safety feature in which, in the event of a loss of power to the control solenoid 182, the pump/motor 170 moves immediately to a neutral configuration, thereby minimizing danger of further mishap or damage.

The use of directional terms, such as left and right, and up and down, is for convenience in describing the function and operation of embodiments described with reference to the attached figures. It will be recognized that the actual directions of applied force and travel will depend upon configurations and orientation, and thus may have no relation to the descriptions made herein. Thus, the scope of the invention is not limited by such terms. Additionally, while the actuator valves of the embodiments described with reference to the attached figures are described as spool valves, it will be understood that other valves may be used that are functionally identical, while being structurally quite distinct, including combinations of valves. Accordingly, the scope of the invention is not limited to spool valves or to a single valve.

Pump/motors of the type described herein are, among other, applications, commonly employed in the operation of motor vehicles, including heavy construction machinery and farm machinery, as well as passenger vehicles such as busses and automobiles. Applications of this nature are described in detail in U.S. Pat. No. 5,495,912, and U.S. patent application Ser. No. 10/731,985 (filed Dec. 10, 2003), which are incorporated herein by reference, in their entirety. Vehicles incorporating pump/motors having actuator systems as described herein are considered to fall within the scope of the invention.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A hydraulic actuator device, comprising:

a piston within a cylinder, the cylinder having a first fluid port in fluid communication with an open side of the piston, and a second fluid port in fluid communication with a shaft side of the piston, the piston configured to travel in a first direction, toward the shaft side of the piston and in a second direction, toward the open side of the piston;

a valve circuit having a valve configured to selectively couple the first fluid port with a high-pressure fluid source while in a first position, and with a low-pressure fluid source while in a second position, the valve further configured to couple the second fluid port to the high-pressure fluid source while in the first or second positions, and the valve also configured to close the second fluid port while in a third position; and a feedback mechanism configured to apply a biasing force to the valve in a direction toward the first position, piston travel in the second direction tending to increase the biasing force and piston travel in the first direction tending to decrease the biasing force.

2. The hydraulic actuator device of claim 1 wherein the valve circuit is further configured to close the first fluid port while in the second position.

3. The hydraulic actuator device of claim 1 wherein the valve is a spool valve having first and second control ports coupled to the first and second fluid ports, respectively, the spool valve being configured to place the first and second control ports in fluid communication with the high-pressure fluid source when a spool of the spool valve is in the first position, the spool valve being configured to close the second pressure port when the spool is in the third position, and the spool valve being configured to place the first control port in fluid communication with the low-pressure fluid source and the second control port in fluid communication with the high-pressure fluid source when the spool is in the second position.

4. The hydraulic actuator device of claim 3 wherein the spool valve is further configured to close the first control port when the spool is in the second position.

5. The hydraulic actuator device of claim 3, further comprising a solenoid configured to variably apply biasing force to the spool to urge the spool from the first position toward the third position, and from the third position toward the second position, according to a voltage level at an input of the solenoid.

6. The hydraulic actuator device of claim 1 wherein the feedback mechanism is a mechanical linkage configured to vary biasing force against a spring coupled to the valve.

7. The hydraulic actuator device of claim 1 wherein the feedback mechanism is an electro-mechanical linkage comprising:

a position sensor configured to sense a position of the piston; and a solenoid coupled to the valve, configured to vary the biasing force against the valve according to the sensed position of the piston.

8. The hydraulic actuator device of claim 1, further comprising high and low-pressure fluid sources each coupled to the valve circuit.

9. A system, comprising:

a pump/motor configured to have a displacement directly related to a stroke angle of a cylinder barrel relative to a drive plate;

an actuator coupled to the cylinder barrel and configured to vary the stroke angle thereof according to a position of a shaft of the actuator, the actuator having a piston coupled to the shaft, the piston configured to move within a cylinder in response to differential pressure acting on first and second surfaces thereof; and a valve configured to couple a high-pressure fluid source to the actuator such that high-pressure fluid is made to act on the first and second surfaces of the piston when the valve is in a first valve position, resulting in movement of the shaft in a first direction, the valve configured to couple the high-pressure fluid source and a low pressure fluid source to the actuator such that high-pressure fluid is made to act on the first surface of the piston while low-pressure fluid is made to act on the second surface of the piston when the valve is in a second valve position, resulting in movement of the shaft in a second direction, and the valve configured to decouple the high and low-pressure fluid sources from the actuator when the valve is in a third valve position, resulting in arresting movement of the shaft; and a feedback mechanism configured to apply a biasing force to the valve in a direction toward the first valve position, piston travel in the second direction tending to increase the biasing force to the valve, and piston travel in the first direction tending to decrease the biasing force.

10. The system of claim 9 wherein the valve is a hydraulic spool valve, comprising:

a first control port coupled to a first fluid port of the actuator;

a second control port coupled to a second fluid port of the actuator, the spool configured to travel between first, second, and third spool positions corresponding, respectively, to the first, second, and third valve positions, the spool valve being configured to place the first and second control ports in fluid communication with the high-pressure fluid source when the spool is in the first position, to place the first control port in fluid communication with a low-pressure fluid source and the second control port in fluid communication with a high-pressure fluid source when the spool is in the second position, and to close the second control port when the spool is in the third position.

11. The hydraulic spool valve of claim 10 further comprising first and second pressure fluid ports configured to be coupled to the high and low-pressure fluid sources, respectively.

12. The hydraulic spool valve of claim 11 further comprising a third pressure fluid port configured to be coupled to the high-pressure fluid source.

13. The system of claim 9 wherein the actuator is coupled to the cylinder barrel such that movement of the shaft in the first direction causes the cylinder barrel to rotate in a direction that reduces the angle of the cylinder barrel relative to the drive plate, while movement of the shaft in the second direction causes the cylinder barrel to rotate in a direction that increases the angle of the cylinder barrel relative to the drive plate.

14. The system of claim 9, further comprising a high-pressure accumulator configured to serve as the high-pressure fluid source, and a low-pressure accumulator configured to serve as the low-pressure fluid source.

15. The system of claim 9, further comprising a vehicle having a drivetrain coupled to an output shaft of the pump/motor and configured to receive motive force therefrom.

16. A method, comprising:

moving a valve to a first position, and thereby applying high pressure to first and second surfaces of a piston coupled to a shaft of an actuator to move the shaft toward a first limit of movement;

moving the valve to a second position, and thereby applying high pressure to the first surface and low pressure to the second surface of the piston to move the shaft toward a second limit of movement; and moving the valve to a third position, and thereby shutting off pressure access to the first and second surfaces of the piston to arrest the actuator in a position between the first and second limits of movement;

applying a biasing force to the valve urging the valve toward the first position;

increasing the biasing force in relation to movement of the piston toward the second limit of movement; and decreasing the biasing force in relation to movement of the piston toward the first limit of movement.

17. The method of claim 16, further comprising rotating an axis of a pump/motor barrel in a first direction relative to a drive plate of the pump/motor by moving the shaft toward the first limit of movement, and rotating the axis of the pump/motor barrel in a second direction relative to the drive plate by moving the shaft toward the second limit of movement.

18. The method of claim 17, further comprising decreasing a rate of energy transfer between a high-pressure source and an output shaft of the pump/motor by rotating the axis of the pump/motor barrel in the first direction relative to the drive plate, and increasing the rate of energy transfer between the high-pressure source and the output shaft of the pump/motor by rotating the axis of the pump/motor barrel in the second direction relative to the drive plate.

19. The method of claim 18, further comprising adjusting motive power to a vehicle by selectively increasing or decreasing energy transfer between the high-pressure source and the output shaft of the pump/motor.

20. The hydraulic actuator device of claim 5 wherein the feedback mechanism is configured to move the spool to the first position when a voltage level at the input of the solenoid is below a threshold voltage.

21. The system of claim 9 wherein the feedback mechanism is a mechanical linkage configured to vary biasing force against a spring coupled to the valve.

22. The system of claim 9 wherein the feedback mechanism is an electro-mechanical linkage comprising:

a position sensor configured to sense a position of the piston; and a solenoid coupled to the valve, configured to vary the biasing force to the valve according to the sensed position of the piston.

23. The system of claim 13, comprising a solenoid configured to variably apply biasing force to the valve to urge the valve from the first position toward the third position, and from the third position toward the second position, according to a voltage level at an input of the solenoid.

24. The system of claim 23 wherein the feedback mechanism is configured to move the spool to the first position when a voltage level at the input of the solenoid is below a threshold voltage.

* * * * *